US005544599A

United States Patent [19]

Frazer et al.

[11] Patent Number: 5,544,599

[45] Date of Patent: Aug. 13, 1996

[54] PROGRAM CONTROLLED QUILTER AND PANEL CUTTER SYSTEM WITH AUTOMATIC SHRINKAGE COMPENSATION

[75] Inventors: James T. Frazer; David B. Scott, both of Coral Springs, Fla.; James F. Bondanza, Fremont, Calif.

[73] Assignee: L&P Property Management Company, Chicago, Ill.

[21] Appl. No.: 271,420

[22] Filed: Jul. 6, 1994

[51] Int. Cl.[6] ..... D05B 11/00

[52] U.S. Cl. ..... 112/118; 112/470.03; 112/475.02; 112/475.08; 112/314; 226/24

[58] Field of Search ..... 112/117, 118, 112/119, 305, 307, 314, 315, 470.03, 475.02, 475.01, 470.04, 470.05, 470.31, 470.32, 475.08; 226/24

[56] References Cited

U.S. PATENT DOCUMENTS

| | | | |
|---|---|---|---|
| 3,867,889 | 2/1975 | Conner, Jr. | 112/470.03 |
| 3,960,095 | 6/1976 | Story | 112/118 |
| 4,037,546 | 7/1977 | Kleinscmidt | 112/470.32 X |
| 4,785,750 | 11/1988 | Best . | |
| 4,815,405 | 3/1989 | Young, Jr. . | |
| 5,018,416 | 5/1991 | Freerman . | |
| 5,154,130 | 10/1992 | Gribetz et al. . | |

*Primary Examiner*—Peter Nerbun

*Attorney, Agent, or Firm*—Wood, Herron & Evans, P.L.L.

[57] ABSTRACT

A quilting machine includes a multiple needle quilter with a panel cutter located in-line therewith and downstream thereof and having an accumulator therebetween. A programmable controller operates the quilter to stitch a programmed series of one or more patterns on a web. A feed roller angular encoder measures the quilted web length fed under tension to the accumulator. A detector signals when the accumulator is full, whereupon the controller causes web to be fed from the accumulator to the panel cutter, where it passes without tension thereon toward a photo sensor. The photo sensor signals the controller which activates the cutter to sever a predetermined panel length from the web. The controller then reads information from the encoder and the accumulator detector to determine the amount of stressed quilt required to replenish the cutoff panel length. The ratio of measurements is then processed to determine the elongation change or "shrinkage", which information is used to control the relative feed at the quilter, cutter and fabric supply and to track the quilted patterns and splices in the fabric of the web through the machine.

23 Claims, 1 Drawing Sheet

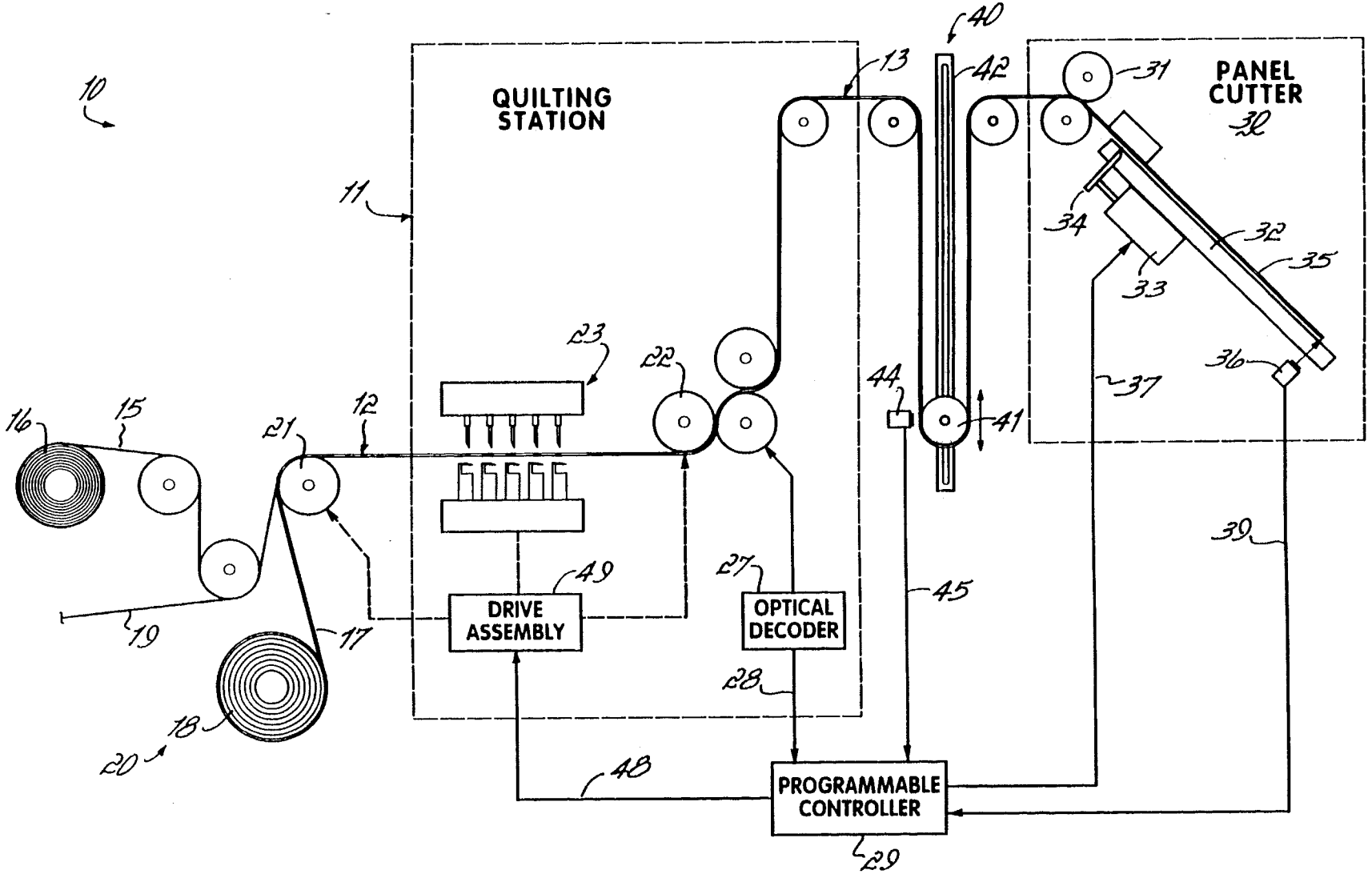
PANEL CUTTER
30
31
32
33
34
35
36
37
39
40
41
42
44
45
QUILTING STATION
11
12
13
OPTICAL DECODER
27
28
PROGRAMMABLE CONTROLLER
29
DRIVE ASSEMBLY
49
48
21
22
23
15
16
17
18
19
20
10

PROGRAM CONTROLLED QUILTER AND PANEL CUTTER SYSTEM WITH AUTOMATIC SHRINKAGE COMPENSATION

The present invention relates to quilting machines, and particularly to methods and apparatus for controlling the feed between fabric-quilting and panel-cutting sections of such machines.

BACKGROUND OF THE INVENTION

In large scale multiple needle quilting machines, several layers of fabric web are brought together at a quilting station where they are sewn together by the stitching of patterns thereon. The patterns are formed by moving the composite multiple layered fabric web relative to a bank of stitching elements that include an array of needles above the fabric and a corresponding array of loopers or other cooperating stitching elements below. The relative motion of the fabric and the stitching elements is often carried out under the control of a programmable controller.

The programs of the controllers are varied in order to produce a variety of patterns to satisfy the requirements of the customers of the quilted fabrics. These customers are often the manufacturers of mattresses and other upholstered items. The customers' requirements are varied, and each may order from a quilt manufacturer a number of different patterns in small or moderate quantities, requiring the quilt manufacturer to frequently change the pattern program and possibly also the fabric material.

When quilts are stitched, a series of a panel-length sections of quilted patterns emerge from a downstream end of the quilting station of the quilting machine as part of a single continuous web. The series might include multiple copies of the same pattern sewn on the same material, a series of different patterns sewn on the same material, or a series of the same or different patterns sewn on different types of material spliced together to form the continuous web. To automate the production control of various types of panels or batches of panels, quilting machines, such as that disclosed in U.S. Pat. No. 5,154,130, have for several years included a programmed controller that is programmed to cause the movement of the fabric relative to the stitching elements to produce the various patterns. The controllers have also been programmed to change from pattern to pattern in accordance with a production schedule, and to signal the need to splice materials where called for by the order description.

Each of the panel length sections of quilted web that emerge from the quilting station must ultimately be cut from the web to form individual quilted panels. This has been achieved by placing a panel cutter in line with and downstream of the quilting station. The panel cutter includes a transverse knife or blade that is actuated to cut transversely across the quilted fabric to separate the individual panels from the web. The stitching of various panels of one or more patterns onto a web of one or more material types and the cutting of the discrete quilted panels from the web at the proper point along the web requires coordination of the panel cutter knife in severing the individual panels from the web, the positioning of the web at the quilting station so that quilting needle movement properly locates the patterns on the web, and properly identifies the location of the splices in the fabric. This coordination has been conventionally carried out primarily with manual monitoring by an operator and manual decision making.

The coordination of a panel cutting operation with a stitching operation and the splicing of material in a web that is being formed into a series of quilted patterns is complicated by the phenomenon referred to in the quilting industry as "shrinkage". Shrinkage of the fabric is a result of the stitching together of multiple layers of fabric that include the top and bottom layers with a filler layer in between. As the layers are stitched together, the material tends to gather, causing the fabric to shorten dimensionally in the longitudinal direction along the web. The longitudinal shrinkage is the primary complicating factor in coordinating the operations on the web.

The amount of shrinkage varies among different patterns, due to the different amounts and configurations of the stitching called for by the patterns. When the fabric is under tension in the quilting machine, which is normally the case in that the web is generally pulled through the machine by feed rolls upstream of a particular station, the longitudinal dimensions of the pattern are only slightly, but nonetheless materially, affected by the so called shrinkage. Once the tension is released, however, such as when the fabric is discharged from the machine or fed to the panel cutter, the shrinkage is manifested in a greater shortening of the fabric, often in the order of ten percent of the tensioned length. This greater shortening also may vary, even without a change in the patterns or the material, due to ambient factors such as humidity in the plant in which the quilt is being made.

The dimensions of the cut unstressed panels are the dimensions to which the quilting, splicing and feeding of the web must be coordinated, since these are the specified dimensions of the finished product. In order to produce a panel of a given length, a section of the web of a somewhat greater length must be quilted, and the position and dimensions of the quilted patterns on the web must be adjusted to accommodate for the shrinkage that will occur. In addition, due to the shrinkage, the rate of feed of web through the quilting station and through the panel cutter will differ. Further, the cumulative effects of the shrinkage must be taken into account in order to minimize waste when different materials must be spliced together, and to synchronize the cutter to cut the panels precisely between the patterns.

Thus far, no effective way to control the apparatus to account for shrinkage, absent excessive manual intervention by an operator, has been provided in the prior art. Further, since a majority of the shrinkage occurs beyond the last feed element at the panel cutter, the programmed controllers of the prior art, as discussed above, are inadequate to coordinate automated batch production control where a panel cutter is to be incorporated into a more fully automated system. Accordingly, there remains a need for a more effective method and apparatus for control of the various stages of a quilter/panel-cutter machine that is adequately responsive to the shrinkage of the fabric.

SUMMARY OF THE INVENTION

A primary objective of the present invention is to provide a quilting machine that includes fabric supply, a quilting station and a panel-cutter that are controlled in such a way as to account for longitudinal dimensional change, or shrinkage, in the web caused by the quilting operation.

It is a further objective of the present invention to provide a method of coordinating the relative operation of a panel-cutter and the quilted fabric supply in a quilting machine, taking into account the amount of shrinkage occurring in the web, and adjusting the web feed at various points in the machine to properly synchronize the various components along the web, and to keep track of the positions of the various features on the web as it moves through the quilting machine.

In accordance with the objectives of the present invention, a quilting machine is combined with a panel cutter downstream of the quilting machine and the combination is equipped with a control that repeatedly measures and re-estimates the amount of shortening in longitudinal dimension along a web that occurs as the web is quilted under tension and after tension is removed from the quilting machine. The control is programmed to control the amount of material that must be quilted to make up for the material removed from the downstream end of the web by a panel cutter. Preferably also, the controller controls when the cutting blade of the panel cutter must be activated, and calculates the positions of quilted patterns, material splices and other features along the web as the moving web changes dimensionally.

In its preferred embodiment, the quilting machine of the present invention includes a multiple needle quilting station at which multiple layered fabric is quilted. The quilting machine is connected in line with a panel cutter, located downstream of the quilting station. The panel cutter is provided with feed elements, such as rollers, at its upstream end adjacent a cutter blade at the top of a downwardly inclined gravity fed table. Preferably, an accumulator station is also provided between the quilting station and the panel cutter, to provide some form of web accumulation, such as with the provision of a dancer type roll that rests on top of the web and rides up and down in a track.

The control of the machine of the preferred embodiment of the invention includes a sensor, such as photoelectric eye or other type of web edge presence detector, spaced a predetermined distance downstream of the blade, to detect the arrival of the leading edge of the web at a specific point spaced a predetermined panel-length distance from the cutting blade at the lower end of the inclined table. The sensor signals that a predetermined panel-length amount of quilted fabric has been advanced past the blade. In response to the signal from the detector, the controller generates a signal that activates the cutter blade to cut a panel from the web.

The quilt is under tension between the quilter and the feed rollers of the cutter. This tension drops almost to zero as the fabric passes the cutter feed rollers at the top of the inclined surface. As a result, the quilt relaxes or "shrinks" as it is fed down the inclined surface to the photoelectric eye. Therefore, the signal from the detector also informs the controller that a fixed length of unstressed, and therefore shrunken, quilt has been cut from the web.

The control system of the preferred embodiment of the invention is also provided with a digital encoder mounted on the shaft of one of the quilter feed rollers at the downstream end of the quilter. The encoder accurately measures the running length of quilted web passing under tension through the nip of the quilter feed rollers. A signal is generated by the encoder in the form of a series of digital pulses, each of which, when communicated to the controller, informs the controller that a fixed incremental length of quilted tensioned fabric has been fed out of the quilting station of the quilting machine.

In addition, the controller of the preferred embodiment of the invention has a limit switch or other type of position detector located at the bottom of the accumulator roll track to signal that the accumulator is at its maximum capacity in its extreme downward position. A signal from this detector informs the controller that a precise length of tensioned quilted fabric is present between the quilter and the panel cutter.

In the preferred method of operation of the machine, the quilter will be in operation quilting patterns on the web and feeding quilted web downstream to the accumulator. The cutter feed elements will be stopped. Eventually, the detector in the accumulator signals that the accumulator is at maximum capacity, thus assuring that the accumulator contains enough quilted fabric to supply one panel length of quilted web to the panel cutter. In response to this signal, the counter in the controller that counts pulses from the encoder is reset to zero and the feed elements on the panel cutter are then activated, feeding quilted fabric past the cutter blade and down the inclined table until the leading edge of the quilted web is detected by the photoelectric sensor, signaling that a predetermined length of quilted web extends beyond the cutter blade. The cutter feed elements are then stopped and the cutter blade is activated, in response to the sensor signal, to cut a precise panel length of, for example, 54" from the web. Thereupon, the controller records this cut length. This is the unstressed length of quilt fed from the accumulator, shrunken to the extent of the relaxation of the tension on the quilted fabric.

While the quilter has been quilting, the controller has been counting the number of pulses from the output signal that have been received since the cutter feed rolls were started in response to the signal from the accumulator maximum limit switch. When the accumulator roll again reaches its maximum capacity position, the count from the encoder is read by the controller indicating the amount of stressed and therefore unshrunken quilted fabric that was required to be resupplied by the accumulator to make up for the panel length that was cut from the web. The measured amount of stretched quilt fed into the accumulator minus the shrunken fixed length of the cut panel is the amount of shrinkage. The ratio of this shrinkage to the fixed length of either the stressed or shrunken web may be considered a shrinkage ratio.

The shrinkage that is calculated is, however, the amount of shrinkage experienced by the last panel length that was cut by the cutter, which is not necessarily the amount of shrinkage of the next panel length to be cut, but nonetheless serves as an estimate or prediction of what that length will be.

The calculated shrinkage is used by the controller to control the amount of feed of fabric to the quilting station, to control the location of the quilted pattern on the web, to control the elongation of the quilted pattern on the web, and to control the feed of the quilted web out of the quilting station.

The present invention is important not only to keep the length of material through the quilter and cutter flowing at the appropriate rates to automatically achieve proper location of the patterns on the panels and proper lengths of quilted panels, but to keep track of the locations of splices and pattern changes in the quilted material as small orders or batches of orders of different quilted products are sequentially produced by the computerized pattern control of the quilter.

These and other objectives and advantages of the present invention will be more readily apparent from the following detailed description of the drawings of the preferred embodiment of the invention, in which:

BRIEF DESCRIPTION OF THE DRAWINGS

The FIGURE is a diagram illustrating a quilting machine embodying principles of the present invention.

DETAILED DESCRIPTION OF THE DRAWINGS

Referring to the FIGURE, a large scale commercial quilting machine 10 is diagrammatically illustrated. The quilting portion of such a machine is illustrated and described in greater detail in the commonly assigned U.S. Pat. No. 5,154,130 of Gribetz et al. entitled Multi-Needle Double Lock Chain Stitch Tack, Jump and Thread Trimming Quilting Method and Apparatus, hereby expressly incorporated herein by reference.

The machine 10 includes a quilting station 11 at which stitched patterns are applied to a multiple layered web of fabric 12 to form a quilted web 13. The multiple layered web of fabric 12 is formed by combining a web of top goods 15 from a top goods supply roll 16, a web of backing 17 from a backing material supply roll 18, and a web of filler 19 interposed between the backing and top goods webs at the upstream end 20 of the quilting station 11. The quilting station 11 has front and back sets of transversely extending, transversely shiftable, reversible rollers 21 and 22, respectively, which engage and move the web 12 relative to a stitching mechanism 23 at the quilting station. Of the rollers 21 and 22, the rollers 22 are the primary feed rollers of the quilting station that maintain tension on the web 12 between the rollers 21 and 22. The feed rollers manipulate the web 12 longitudinally relative to the stitching mechanism 23 to define the stitched pattern being applied to the web 12, and control the overall advance or downstream feed of the quilted web 13.

Attached to the shaft of one of the feed rollers 22 is a digital optical encoder 27, or other type of measuring instrument, for measuring the linear feed of the web 13 through the nip of the rollers 22. Preferably, the measuring instrument, such as the digital optical encoder 27, generates a series of digital pulses as the rollers 22 rotate, each pulse corresponding to a fixed length of incremental feed of the web 13 through the rollers 22. The encoder 27 has an output 28 through which the pulses are transmitted to an input of a programmable controller 29. The controller 29 is preferably a microprocessor based digitally programmable industrial controller or general or special purpose digital computer. The controller 29 contains a counter, which may be a specially programmed section of memory connected to the controller processor, that counts pulses from the encoder 27 and therefrom calculates the amount of web 13 fed downstream from the quilting station 11. Because in the course of quilting the web may be longitudinally reversed several times through the quilting station 11 in order to sew 360° or other complex patterns, the pulses from the encoder are direction sensitive so that an algebraic count can be made by the counter of the controller 29 to accurately measure the net feed of the quilted web 13 beyond the feed rollers 22.

Downstream of the quilter 11, the machine 10 includes a panel cutter 30. The panel cutter 30 has, at the upstream end thereof, a set of web feed elements 31, which engage the quilted web 13 being fed from the quilting station 11 and advance it onto a downwardly inclined table 32. The feed elements 31 are preferably in the form of a pair of opposed feed rollers which engage the quilted web 13 and maintain tension on the quilted web 13 on the upstream side of the elements 31. The panel cutter 30 further includes a cutoff mechanism 33, which includes a transverse blade or knife 34, which is operable, upon receipt of a cutoff signal from the controller 29 along line 37, to transversely sever the portion of the downstream end of the quilted web 13 that extends beyond the knife 34 from the upstream portion of the web 13, thereby forming a quilted panel 35.

At the lower end of the table 32 is a sensor 36 operable to detect the presence of quilted fabric. The sensor 36 may be, for example, a photodetector that will generate a signal at the instant that the leading edge of the quilted web 13, fed by the feed elements 31, extends sufficiently beyond the knife blade 34 of the cutoff mechanism 33 and down the inclined surface of the table 32 to reach the sensor 36. When this leading edge is detected by the sensor 36, a signal is communicated along input line 39 to the controller 29.

Between the quilting station 11 and the panel cutter 30 is provided an accumulator section 40 which accumulates quilted web 13 fed from the feed rollers 22 and supplies quilted web 13 to the feed elements 31 of the panel cutter 30. The accumulator section 40 also resupplies web 13 to the feed rollers 22 when the feed of the web 13 is reversed in the course of complex pattern sewing. The accumulator section 40 includes an accumulator roll 41 that extends transverse of the quilted web 13 and generally is supported by the web 13. The weight of the roll 31, which may be in the order of approximately one hundred pounds, is supported by both the upstream and downstream extensions of the web 13 on both sides of the roll 41, thereby establishing and maintaining a generally uniform tension on the web 13. The accumulator section 40 includes a generally vertical track 42 in which the roll 41 moves, either up or down, whenever the rate that the web 13 is being fed downstream from the feed rollers 22 differs from the rate that the web 13 is being fed downstream by the feed elements 31. Specifically, when the feed rate from the feed rollers 22 exceeds the feed rate at the feed elements 31, the roll 41 moves down to take up the excess from the feed elements 22. When the feed rate from the feed elements 31 exceeds the feed rate from the rollers 22, the roll 41 moves up to supply the difference to the feed elements 31.

At the bottom of the track 42 is a limit switch 44, or other suitable roll position detector, which generates a signal along an input line 45 to the controller 29, signaling that the accumulator 40 is at its maximum capacity. A similar switch (not shown) may be provided at the top of the track 42 to signal that the accumulator is at its minimum capacity.

The controller 29 is programmed to respond to a signal from the accumulator maximum capacity switch 44 and, in response thereto, activate the feed elements 31 to feed web 13 from the accumulator 40 onto and down the table 32. It may also be programmed to stop or slow the operation of the quilter 11 so that web 13 is not fed to the accumulator 40 by the feed rollers 22 faster than it is fed from the accumulator 40 by the feed elements 31. Information relating to the net amount of web 13 being fed to the accumulator 40 by the feed rollers 22 is received by the controller 29 from the decoder 27. Information relating to the amount of web 13 fed by the feed elements 31 is recorded as one panel length every time a signal is received from the sensor 36. One panel length is equal to the distance of the sensor 36 from the knife blade 34 on the panel cutter 30.

The overall operation of the quilter 11 is controlled by the controller 29 along with control signals along a cable 48 to a transmission and drive assembly 49. The controller 29 is further programmed to operate the quilter 11 to move the web 12 relative to the stitching mechanism 23 to produce series of patterns in accordance with a production schedule in which the patterns of the series may change from pattern to pattern.

In operation, multiple layered fabric 12 is quilted to form the quilted web 13 at the quilting station 11 of the quilting machine 10. In the process, the stitching sewn by the stitching mechanism tends to shorten the longitudinal dimension or length of the fabric due to the gathering of the material during quilting. This shortening is resisted by whatever tension is maintained in the longitudinal direction on the web 13. Such tension is typically proportional to the weight of the accumulator roll 41 of the accumulator section 40. The shortening has the effect of imparting a degree of apparent elasticity to the quilted web 13. The quilted web 13 leaves the quilting station 11, passing through the feed rollers 22 under this maintained tension. The digital encoder 27 on the shaft of one of the feed rollers 22 accurately measures the running length of quilted web 13 that passes through the nip of the feed rollers 22.

From the feed rollers 22, the quilted web 13 passes downstream to the accumulator 40 at which the roll 41 rests on top of the web 13 and rides down in the track 42. The feed elements 31 on the panel cutter 30 are at this time inactive, so none of the web 13 is being fed from the accumulator 40 to the panel cutter 30. When the roll 41 of the accumulator 40 reaches the bottom of the track 42 as the web 13 fed from the rollers 22 fills the accumulator 40, the switch 44 is activated, which generates a signal to the controller 29 indicating that the accumulator 40 is full. In response to this signal, the controller 29 activates the feed elements 31 to feed web 13 out of the downstream end of the accumulator 40 and down the table 32. Simultaneous with the activation of the feed elements 31, the controller 29 stores the count of the pulses from the encoder 27 and resets its counter to restart the counting of the pulses from the encoder 27.

The feed elements 31 of the panel cutter 30 operate to advance the quilted web 13, which is under tension on the upstream side of the elements 31, onto a downwardly inclined surface of the table 32, where the only tension on the web 13 is weight of the quilted fabric itself. With this reduction of tension, the web longitudinally shortens or shrinks. The feed elements 31 continue to feed the web 13 onto the table 32 until the leading edge of the web 13 is optically detected by the photoelectric detector or eye 36. At this point, the detector 36 generates a signal that is communicated to the controller 29, in response to which the controller stops the feed rolls 31 and sends a cutoff control signal to the cutting mechanism 33 to activate the knife blade 34 to transversely sever a panel at which point a transverse knife is actuated at the top of the inclined surface to cut a panel from the leading end of the web that is of a precise length equal to the distance from the photodetector 36 to the knife blade 34.

Since the quilted web 13 was under tension between the quilter feed rollers 22 and cutter feed elements 31, and the tension in the web 13 dropped almost to zero as the fabric passed the cutter feed elements 31 the top of the inclined surface, the quilt has relaxed or shrunken as it was fed down the inclined surface of the table 32 to the photoelectric detector 36, so that the cut panel has shortened to its unstressed finish panel length. So for 54" knife to sensor spacing, which produces panel length of a 54" finished dimension, a greater length (as for example, 59" or 60" of web 13) is fed from the accumulator 40.

When the knife 34 is activated, the controller simultaneously stops the feed elements 31, thus stopping the feed of quilted web 13 out of the accumulator 40. Then, the next time the switch 44 detects the presence of the accumulator roll 41 at the bottom of the track 42, the count in the counter of the controller 29 will represent the amount of stretched quilted web 13 that had to be fed from the feed rollers 22 to replenish the amount of quilted web 13 fed to the panel cutter 30. The length of this amount of web 13 fed to the accumulator 40 that is in excess of the predetermined length of the cut panel, when divided by the length of the cut panel, equals the shrinkage factor of the panel, which is a fraction of the stretched length of the web 13. Thus, measured by the detector 36, for example, 59 or 60" must be quilted and fed from the quilter 11 for each 54" panel to be produced.

The system predicts this shrinkage by repeated measurements. Each time the cutter mechanism 33 is activated and a precise panel length of, for example, 54" is cut from the quilted web 13, the controller 29 records 54" of unstretched quilt as being fed from the accumulator 40, shrunken to the extent that the relaxation of the tension on the fabric. The amount of contraction or shrinkage varies as the quilted patterns are changed by the pattern control program of the controller 29. The shrinkage also varies as factors such as humidity in the plant vary, and due to other factors that cannot be readily predicted.

The shrinkage factor on the quilted fabric that is realized when the tension on the fabric is relaxed is variable and might, for example, average 10 percent. To measure the shrinkage, the program in the controller 29 utilizes the fact that, when the accumulator roll 41 is at its extreme bottom position in its track, a known length of tensioned quilted fabric exists between the feed rollers 22 at the exit of the quilter 11 and the feed elements 31 at the front of the cutter 30. Thus, by activating the cutter feed elements 31 whenever the accumulator roll 41 is at its bottom position to feed one untensioned length of quilt past the cutter blade 34, and then measuring the amount of quilted material fed from the quilter 11 by the quilter feed rollers 22 until the accumulator roll 41 again reaches its bottom position, the exact length of shrinkage can be calculated.

The shrinkage that is calculated is, however, the amount of shrinkage experienced by the last panel length that was cut by the cutter. This is not necessarily the amount of shrinkage to be experienced by the length of the next panel length to be cut, but nonetheless serves as an estimate of that length. In operation, the quilter will usually operate continuously while the panels are being fed and cut. Therefore, the running estimate of shrinkage is constantly being made and corrected as data of the lengths of fabric fed from the quilter and to the cutter are generated. The throughput of the quilter and cutter are thereby coordinated and controlled.

The invention is important not only to keep the length of material through the quilter 11 and cutter 30 flowing at the approximate same rate, but to keep track of the locations of splices and pattern changes in the quilted material as small orders of different products are sequentially produced by the quilter under the control of the computerized pattern control program of the controller 29. The prediction of shrinkage is factored into the pattern control program so that the patterns can, where desired, be centered on a panel of the predetermined finished unstressed shrunken length that it will assume on the table 32 of the panel cutter 30.

The calculated shrinkage is used by the controller 29 to control the amount of feed of web 12 to the quilting station 11, to control the location of the quilted pattern in relation to the web 12, to control stitching mechanism 23 and drive assembly 49 to adjust the elongation or spacing of the quilted patterns so that they occupy the appropriate length or positions on the shrunken cut panels, and to control the feed of the quilted web 13 out of the quilting station 11. The control also uses the shrinkage calculation to either register the patterns on the web in relation to the locations of material splices on the web, or to signal where splices are to be made in the webs of fabric 15, 17 and 19 being fed to the quilter.

From the above description of the preferred embodiments of the invention, it will be apparent to those skilled in the art that changes and additions to the method and apparatus can be made without departing from the principles of the present invention.

Accordingly, the following is claimed:

1. An apparatus for manufacturing quilted panels from a continuous quilted web formed of multiple layers of fabric, the apparatus comprising:

a quilting station having a stitching mechanism thereat operable to sequentially quilt a series of patterns along a multiple layered web of fabric extending through the quilting station;

feed rollers rotatably supported at the quilting station and positioned to drivably engage and longitudinally feed the quilted web of fabric downstream through the quilting station;

a longitudinal feed measuring device linked to the feed rollers and operative to generate a signal proportional to the length of fabric being fed downstream through the quilting station;

a panel cutter downstream of the quilting station positioned to receive the quilted web of fabric from the quilting station, the panel cutter having a transverse cutoff mechanism mounted thereon that is operable to transversely sever a panel of quilted fabric from the web in response to a cutoff signal;

feed elements on the panel cutter operable to advance a leading edge of the quilted web of fabric through and beyond the cutoff mechanism;

sensing means for generating the cutoff signal in response to the feeding of a predetermined length of quilted web past the cutoff mechanism; and a controller having means for computing, in response to signals from the measurement device and the sensing means, a longitudinal dimensional change between the web fed from the quilting station and the web fed beyond the cutoff mechanism, to control the positioning of quilted patterns on the web at the quilting station and the feed of the web at the quilting station.

2. The apparatus of claim 1 wherein the sensing means comprises a web presence detector positioned downstream of the cutoff mechanism of the panel cutter, said web presence detector being operable to communicate to the controller a signal responsive to the feeding of a predetermined length of dimensionally shortened quilted web past the cutoff mechanism.

3. The apparatus of claim 1 further comprising:

an encoder linked to the feed rollers and operable to communicate to the controller information relating to the length of tensioned quilted web fed downstream through the quilting station.

4. The apparatus of claim 1 further comprising:

an accumulator positioned in-line between the quilting station and the panel cutter for accumulating the difference between the amount of web being fed through the quilting station that is in excess of the amount of web being fed to the panel cutter.

5. The apparatus of claim 4 wherein:

the accumulator includes a detector operable to communicate to the controller a signal indicating that a known length of web is present between in a defined region between the quilting station and the panel cutter;

the controller being programmed to activate the feed elements in response to the signal from the detector.

6. The apparatus of claim 1 wherein the sensing means includes:

a web presence detector positioned downstream of the cutoff mechanism of the panel cutter, said web presence detector being operable to communicate to the controller a signal responsive to the feeding of a predetermined length of dimensionally shortened quilted web past the cutoff mechanism; and the apparatus further comprises:

an encoder linked to the feed rollers and operable to communicate to the controller information relating to the length of tensioned quilted web fed downstream through the quilting station;

an accumulator positioned in-line between the quilting station and the panel cutter for accumulating the difference between the amount of web being fed through the quilting station that is in excess of the amount of web being fed to the panel cutter;

the accumulator including a detector operable to communicate to the controller a signal indicating that a known length of web is present between in a defined region between the quilting station and the panel cutter; and the controller being programmed to activate the feed elements in response to the signal from the detector, and to calculate the longitudinal dimensional change by comparing the combination of information from the detector and the encoder with information from the sensor.

7. An apparatus for manufacturing a series of quilted panels from a continuous multiple layered web of fabric, the apparatus comprising:

a quilting station having a stitching mechanism thereat operable to sequentially quilt a series of patterns along a multiple layered web of fabric extending through the quilting station;

feed rollers rotatably supported at the quilting station and positioned to drivably engage and longitudinally feed the quilted web of fabric downstream through the quilting station;

a panel cutter positioned downstream of the quilting station so as to receive the quilted web of fabric from the quilting station, the panel cutter having a transverse cutoff mechanism mounted thereon that is operable to transversely sever a panel of quilted fabric from the web in response to a cutoff signal;

feed elements mounted relative to the panel cutter and operable to advance the quilted web of fabric so as to extend through and beyond the cutoff mechanism; and a controller programmed to control the feed rollers and the stitching elements to stitch a programmed series of patterns along the web and to coordinate therewith the rates of feed of the feed rollers and the feed elements so as to compensate for longitudinal dimensional changes in the web between the quilting station and beyond the cutoff mechanism of the panel cutter.

8. The apparatus of claim 7 further comprising:

means for measuring the longitudinal dimensional changes in the web between the quilting station and beyond the cutoff mechanism of the panel cutter; and the controller being programmed to control the feed rollers and the stitching elements so as to vary in relation to the measured longitudinal dimensional change.

9. The apparatus of claim 7 further comprising:

an encoder linked to the feed rollers to measure the feed of quilted web through the quilting station;

a sensor fixed relative to the cutoff mechanism to measure quilted web fed to the cutoff mechanism; and the encoder and the sensor having outputs connected to the controller.

10. The apparatus of claim 7 wherein:

an accumulator mounted in line between the quilting station and the panel cutter for accumulating web being fed through the quilting station in excess of web being fed to the panel cutter.

11. The apparatus of claim 7 wherein:

the controller includes means for tracking the positions of patterns quilted on the web from the quilting station to the panel cutter.

12. The apparatus of claim 7 wherein:

the controller includes means for tracking splices of material in the web through the quilting station and to the panel cutter.

13. A method of controlling a quilting machine that is operable to automatically quilt patterns upon a web and cut quilted panels from an end of the web, the method comprising the steps of:

detecting dimensional changes in the length of a web; and automatically controlling the feeding of quilted web from a quilting section of the machine and the feeding of quilted web to a cutoff section of the machine in response to detection of dimensional changes in the length of the web.

14. The method of claim 13 further comprising the step of:

deriving in a digital processor the dimensional changes in the length of the web from data derived from measurements of the feed of the web at the quilting and cutoff sections.

15. The method of claim 13 further comprising the steps of:

sequentially stitching a programmed series of patterns on web as it is fed through the quilting section;

the controlling step including the step of varying the relationship between the feeding through the quilting section and to the cutoff section in response to differences in the dimensional changes in the web between different patterns of the series.

16. The method of claim 13 further comprising the steps of:

sequentially stitching a programmed series of patterns on web as it is fed through the quilting section;

tracking, in a digital processor, the locations of the patterns along the web; and the controlling step including the step of controlling, in response to the tracking in the computer, the cutting of the patterns from the web.

17. The method of claim 13 wherein the controlling step includes the steps of:

accumulating quilted web between the quilting and the cutoff sections;

initiating the feeding of quilted web to the cutoff section in response to the accumulation of quilted web between the sections;

cutting a predetermined length panel from the web at the cutoff section in response to the feeding of the length thereto;

feeding quilted web through the quilting section so as to replenish the web fed to the cutoff section;

measuring the length of web fed through the quilting section;

deriving in a digital processor, based on the input thereto of digital information of the measured length and the predetermined length, the dimensional change of the web; and further operating the machine in accordance with parameters based on the derived dimensional change.

18. A method of controlling a combination quilting and panel cutter machine that is operable to automatically quilt patterns upon a web and cut quilted panels from the web, the method comprising the steps of:

automatically controlling the feeding of a web into and through a quilting section of the machine and the feeding of quilted web into and through a cutoff section of the machine;

cutting the quilted web into quilted panels in the cutoff section of the machine;

determining dimensional shrinkage change in the length of the web which occurs in the course of creating a quilted panel; and utilizing the determined dimensional shrinkage change which occurs in the creation of one quilted panel as an input to control the quilting section of the machine during the creation of at least one subsequent quilted panel.

19. The method of claim 18 wherein the web is fed into and through the quilting section of the machine under controlled tension stress and the quilted web is relatively unstressed when fed through the cutoff section of the machine.

20. The method of claim 19 wherein the dimensional shrinkage change is determined by comparing the length of an unstressed quilted panel to the length of tension stressed web utilized to create the unstressed quilted panel.

21. A combination quilting and panel cutter machine operable to automatically quilt patterns upon a web and cut quilted panels from the web, comprising:

means for automatically feeding a web into and through a quilting section of the machine and for feeding quilted web into and through a cutoff section of the machine;

means for cutting the quilted web into quilted panels in the cutoff section of the machine;

means for determining dimensional shrinkage change in the length of the web which occurs in the course of creating a quilted panel; and means for utilizing the determined dimensional shrinkage change which occurs in the creation of one quilted panel as an input to control the quilting section of the machine during the creation of at least one subsequent quilted panel.

22. The machine of claim 21 wherein the feeding means is operable to feed the web into and through the quilting section of the machine under controlled tension stress and to feed the quilted web while relatively unstressed through the cutoff section of the machine.

23. The machine of claim 22 wherein the means for utilizing the dimensional shrinkage change creates an input signal to the quilting section of the machine as a result of comparing the length of an unstressed quilted panel to the length of tension stressed web utilized to create the unstressed quilted panel.

* * * * *